US005443137A

United States Patent [19]

Welser

[11] Patent Number: 5,443,137

[45] Date of Patent: Aug. 22, 1995

[54] SCAFFOLD BOARD AND METHOD FOR MAKING THE SAME

[75] Inventor: Wolfgang Welser, Ybbsitz, Austria

[73] Assignee: Josef Welser oHG Profilier- und Stanzwerk, Ybbsitz, Austria

[21] Appl. No.: 348,676

[22] PCT Filed: Jul. 4, 1991

[86] PCT No.: PCT/EP91/01257

§ 371 Date: Jan. 6, 1993

§ 102(e) Date: Jan. 6, 1993

[87] PCT Pub. No.: WO92/01131

PCT Pub. Date: Jan. 23, 1992

Related U.S. Application Data

[63] Continuation of Ser. No. 966,146, Jan. 6, 1993, abandoned.

[30] Foreign Application Priority Data

Jul. 6, 1990 [DE] Germany ..... 9010264 U

[51] Int. Cl.[6] ..... E04G 1/15

[52] U.S. Cl. ..... 182/222; 182/119

[58] Field of Search ..... 182/222, 223, 119; 52/588

[56] References Cited

U.S. PATENT DOCUMENTS 4,644,724 2/1987 Schijf ..... 52/588

FOREIGN PATENT DOCUMENTS 0268720 6/1988 European Pat. Off. .
2276437 1/1976 France .
2455150 11/1980 France .
2457946 12/1980 France .
1962274 7/1971 Germany .
4556553 11/1979 United Kingdom ..... 182/222
2055944 3/1981 United Kingdom .
2058188 4/1981 United Kingdom .
1590522 6/1981 United Kingdom .
WO89/00635 1/1989 WIPO .

*Primary Examiner*—Alvin C. Chin-Shue
*Attorney, Agent, or Firm*—Skjerven, Morrill, MacPherson, Franklin & Friel; Alan H. MacPherson

[57] ABSTRACT

To improve the stability of a scaffold board consisting of an upper sheet section and a lower waved sheet section and to reduce its weight at the same time, the lower sheet section is connected with its wave tops substantially pointwise to the upper sheet section. The resultant cavities are foamed with an expanding and curing foam, with the expanding foam squeezing the upper and lower sheet sections apart.

22 Claims, 5 Drawing Sheets

SCAFFOLD BOARD AND METHOD FOR MAKING THE SAME

This application is a continuation of application Ser. No. 07,966,146, filed Jan. 6, 1993 now abandoned which corresponds to International Application No. PCT/EP91/01257, filed Jul. 4,1991.

DESCRIPTION

This invention relates to a method for making a scaffold board for a building scaffold wherein a substantially smooth and continuous upper sheet section which forms the upper side of the scaffold board is connected to a waved lower sheet section which has wave bottoms and wave tops of a trapezoidal cross-section and forms the bottom side of the scaffold board and the cavity formed between the upper and lower sheet sections is subsequently foamed with a foam which expands during curing.

Such a scaffold board is e.g. known from French application 24 57 946. In this application, however, the scaffold board consists of an upper continuous plank and a lower continuous plank, with a sheet waved in the form of a trapezoid being provided as a core between the two planks.

In comparison with conventional scaffold boards that consist of thick wooden boards, the above-mentioned scaffold boards have the advantage that they are relatively weatherproof. The use of steel sheets, however, increases the weight of scaffold boards in cases where an adequate stiffness of the boards is desired.

It is therefore the object of the present invention to improve a scaffold board of the above-mentioned kind in such a way that its stability is increased while its weight is reduced at the same time.

This object is attained according to the invention by connecting the lower sheet section substantially pointwise to the upper sheet section on the wave tops of the lower sheet section, which face the upper sheet section, and by subsequently foaming which is formed between the upper and lower sheet sections using a foam that expands during curing and squeezes the sheet sections apart.

The stiffness of the scaffold board is considerably increased by this squeezing apart of the upper sheet section relative to the lower, sheet section. It is here worth mentioning that the sheet thickness of the sheet sections can be kept very small for static reasons. A certain minimum thickness is only required for the upper sheet section to prevent the sheet section from being damaged by falling tools. The linear connection of the upper and lower sheet sections which is substantially pointwise or sectionwise has the effect that the foam filled into the cavity deforms at least slightly during its expansion and squeezes the sections apart. Even in cases where the connection of the wave tops of the lower sheet section to the upper sheet section permits some kind of movement, such movements are prevented by the foam which squeezes the two sheet sections apart. The scaffold board is entirely stiff for a person stepping on the board, i.e. evenly stiff over the entire surface of the scaffold board.

Although a foamed scaffold board is already known from GB 20 58 188, the upper side and the lower side of the scaffold board consist of glass fiber-reinforced plastics and the cavities thereof are merely filled. A squeezing apart of the upper side of the scaffold board and the bottom side is neither intended nor desired because the glass fiber-reinforced plastics would be damaged thereby.

In a preferred embodiment the foam may be polyurethane foam.

The cavity which is enclosed by the upper and lower sheet sections can be implemented in a simple way by bending the upper sheet section downwards along its longitudinal edges and by the upper sheet section surrounding the longitudinal edges of the lower sheet section. This has the advantage that the longitudinal edges need not be connected to each other in a special way. Rather, the foam expanding in the cavity presses into each other the longitudinal edges that encompass each other. In a preferred embodiment the longitudinal edges of the lower sheet section are formed by wave bottoms spaced apart from the upper sheet section, the wave bottoms have formed therein, adjacent to the longitudinal edges, longitudinally extending and upwardly directed beads which are engaged from below by a hook-shaped engaging portion of the upper sheet section. This results in a positive locking of the longitudinal edges of the upper and lower sheet sections when the scaffold board is foamed. At the same time, the longitudinal edges are sealed because of the inclined surfaces pressing against each other, which has the effect that no foam can flow outwards.

Although it would be possible to give the lower sheet section a sinusoidal shape when viewed in cross-section, the selected lower sheet section preferably comprises wave bottoms and tops which are trapezoidal in cross-section. As a result, the total volume of the cavity to be filled with foam can be kept relatively small without the stability of the scaffold board being impaired thereby.

To improve the anti-skid characteristics, the upper sheet section forming the upper side of the board advantageously comprises a walking surface with embossments, with the latter preferably rising towards the upper side of the scaffold board. The embossments have preferably a length greater than their width and are arranged in a pattern similar to a herring bone pattern. In a preferred embodiment the herring bone pattern is oriented obliquely relative to the longitudinal direction of the scaffold board, so that embossments of different longitudinal directions are arranged on the longitudinal edges of the walking surface. This has the advantage that no continuous line which would promote the bending of the scaffold board under pointwise load in the middle of the scaffold board extends in a direction transverse to the longitudinal direction of the walking board.

To further reduce the weight of the scaffold board in a simple way, the thickness of the lower sheet section is advantageously smaller than the thickness of the upper sheet section. Since the function of the upper sheet section is hardly a carrying one, the thickness of the upper sheet section is substantially determined by the necessary impact penetration strength for preventing damage caused by falling tools or the like. Since the bottom side of the scaffold board is not exposed to such stresses, the sheet thickness may be smaller without the static properties of the scaffold board being impaired thereby.

An embodiment of a scaffold board of the invention shall now be explained in more detail with reference to a drawing, in which.

Figure 3:
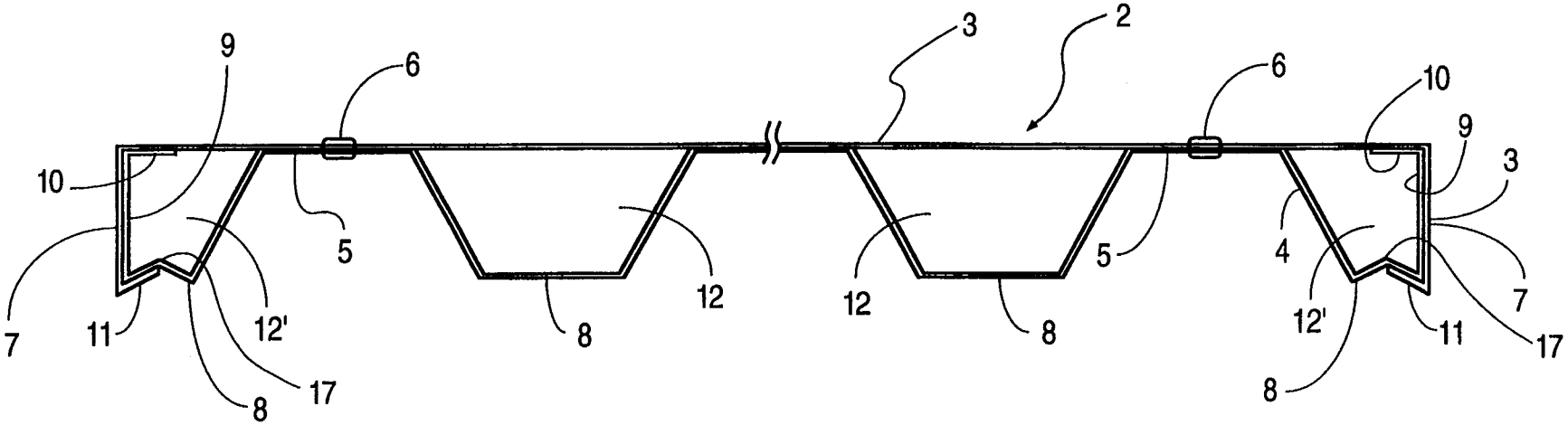
FIG. 3 is a sectional view through the scaffold board of FIG. 1 along line III—III.

As becomes especially apparent from the enlarged cross-sectional view in FIG. 3, the scaffold board 1 as shown in the drawing consists of an upper sheet section 3 forming the upper side 2 and of a lower selected sheet section 4. The profiles achieved through the waves of the lower sheet section 4 which are trapezoidal in cross-section extend in the longitudinal direction of the scaffold board 1. The wave tops 5 which face the upper sheet section 3 are connected at points 6 to the upper sheet section 3 in a joining process, i.e. punched or riveted without the use of foreign material.

The upper and lower sheet sections 3 and 4 are interconnected along the longitudinal edges 7 of the scaffold board. To this end, the lower sheet section 4 ends in the area of the longitudinal edges with a wave bottom 8 which is spaced apart from the upper sheet section 3 more specifically, the lower sheet section 4 ends in the center of the wave bottom 8. The lower sheet section 4 extends therefrom in a vertical section 9 upwards and then ends in a horizontal leg 10.

The upper sheet section 3 externally surrounds the horizontal leg 10 and vertical section 9 and engages a longitudinally extending and upwardly directed bead 17 of the lower wave bottom 8 of the lower sheet section 4 with a freely ending hook-shaped engaging portion 11.

The chambers 12 and 12′ of the cavity which is enclosed by the sheet sections 3 and 4 are foamed with a polyurethane foam which expands during curing, with the chambers 12 and 12′ resulting from the connection of the upper sheet section 3 to the lower sheet section 4,.

Figure 1:
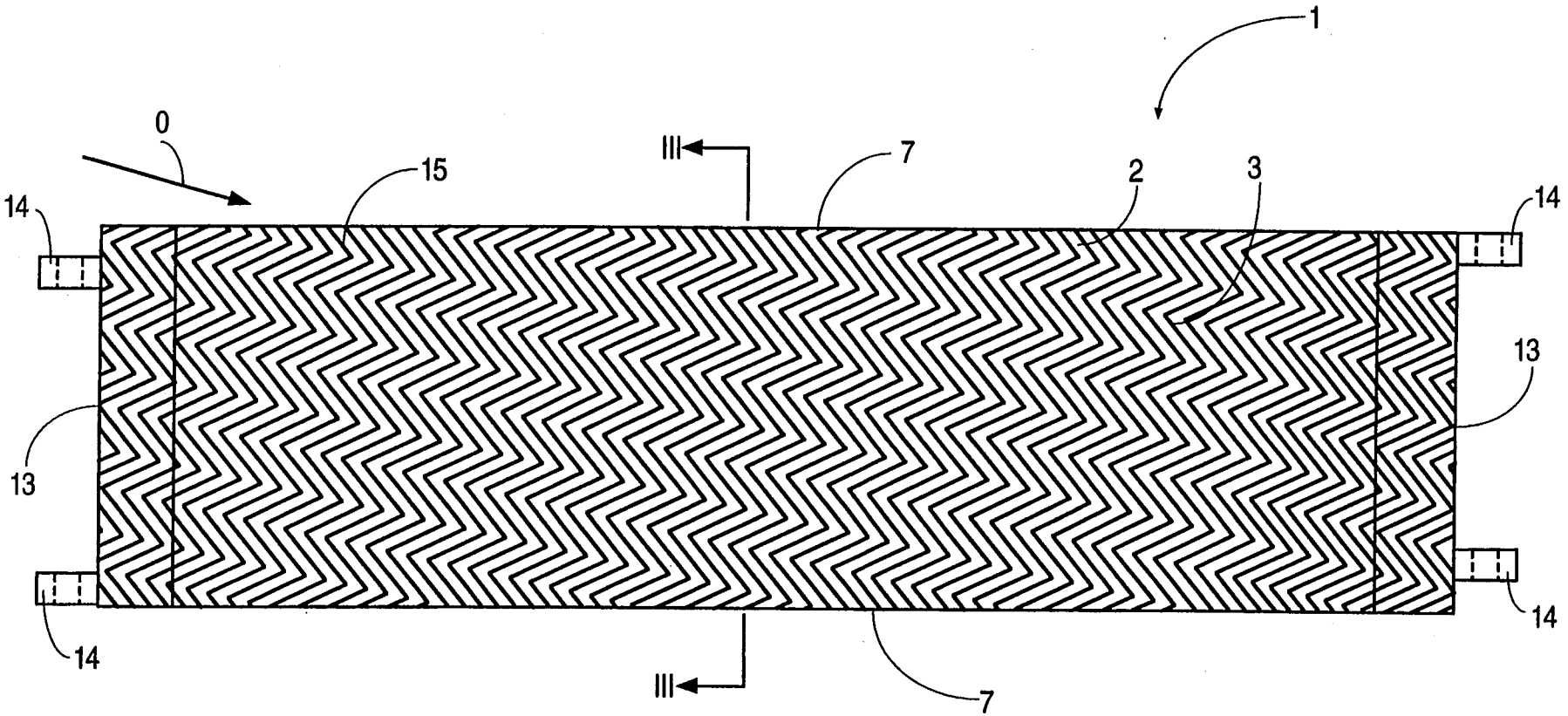
FIG. 1 is a top view on a scaffold board according to the invention.
Figure 2:
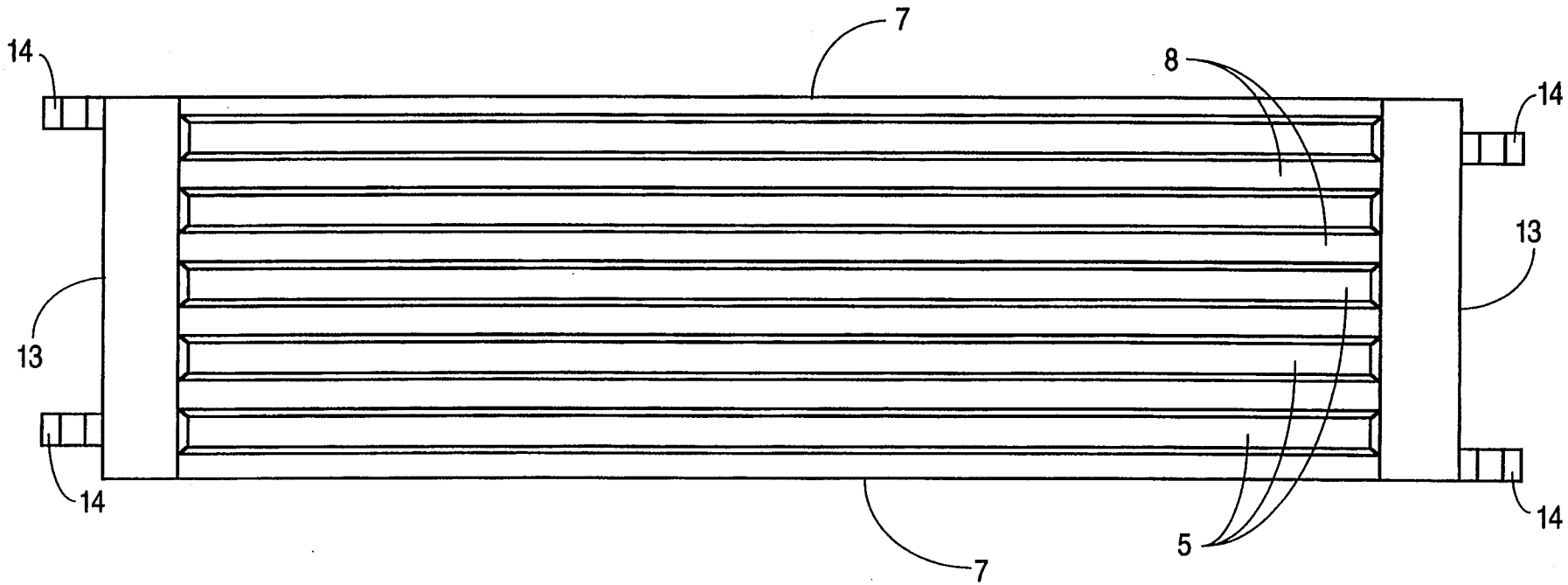
FIG. 2 is a bottom view on the scaffold board of FIG. 1.

As becomes apparent from FIGS. 1 and 2, transverse sections 13 are riveted to the face ends of the scaffold board 1. Connection hooks 14 are secured to these sections for being hung into the scaffold.

Furthermore, as becomes apparent from FIG. 1, the upper side 2 formed by the upper sheet section 3 is provided with embossments 15 which are oriented towards the upper side. The individual embossments 15 have a length greater than their width and are arranged in a herring bone pattern. The longitudinal orientation of the herring bone pattern which is marked by arrow 0 encloses an angle with the longitudinal direction of the scaffold board 1. This has the effect that the embossments 15 do not extend in the same direction over a long distance in the area of the longitudinal edges, whereby the anti-skid characteristics are improved. Furthermore, there is also no continuous line in the transverse direction of the scaffold board, so that a "predetermined breaking point" is not created by the embossments 15.

The operation and function of the scaffold board of the invention shall now be described in more detail in the following text:

For making the scaffold boards, the upper sheet section 3 and the lower sheet section 4 are first produced separately. After the two sheet sections have been cut to the same length, the lower sheet section 4 is slid into the upper sheet section 3 in the longitudinal direction of the scaffold board 1, with the longitudinal edges 7 of the lower sheet section being surrounded by the longitudinal edges of the upper sheet section 3. Subsequently, the upper sheet section 3 is punched with the lower sheet section in the area of the wave tops 5 thereof. Finally, the transverse sections 13 are attached and riveted to the face ends. Subsequently, the chambers 12 and 12′ are foamed with polyurethane foam which expands during curing and entirely fills the cavities and presses also from below into the embossments 15, which effects an additional stiffening of the scaffold board 1. The hook-shaped engaging portion 11 is firmly pressed into the bead 17 of the lower sheet section by the expanding polurethane foam in the chambers 12′, resulting in a stable connection of the longitudinal edges of the upper and lower sheet sections and effecting an efficient seal against exiting foam at the same time.

The sheet which is used for making the scaffold board is preferably a steel sheet with a differential zinc coating. The sheet thickness of the lower sheet section may range from 0.3 to 1 mm depending on the width and length of the scaffold board as well as the demands made thereon whereas the sheet thickness of the upper sheet section depends on the penetration strength required and should rather be more than 0.5 mm.

Figure 4:
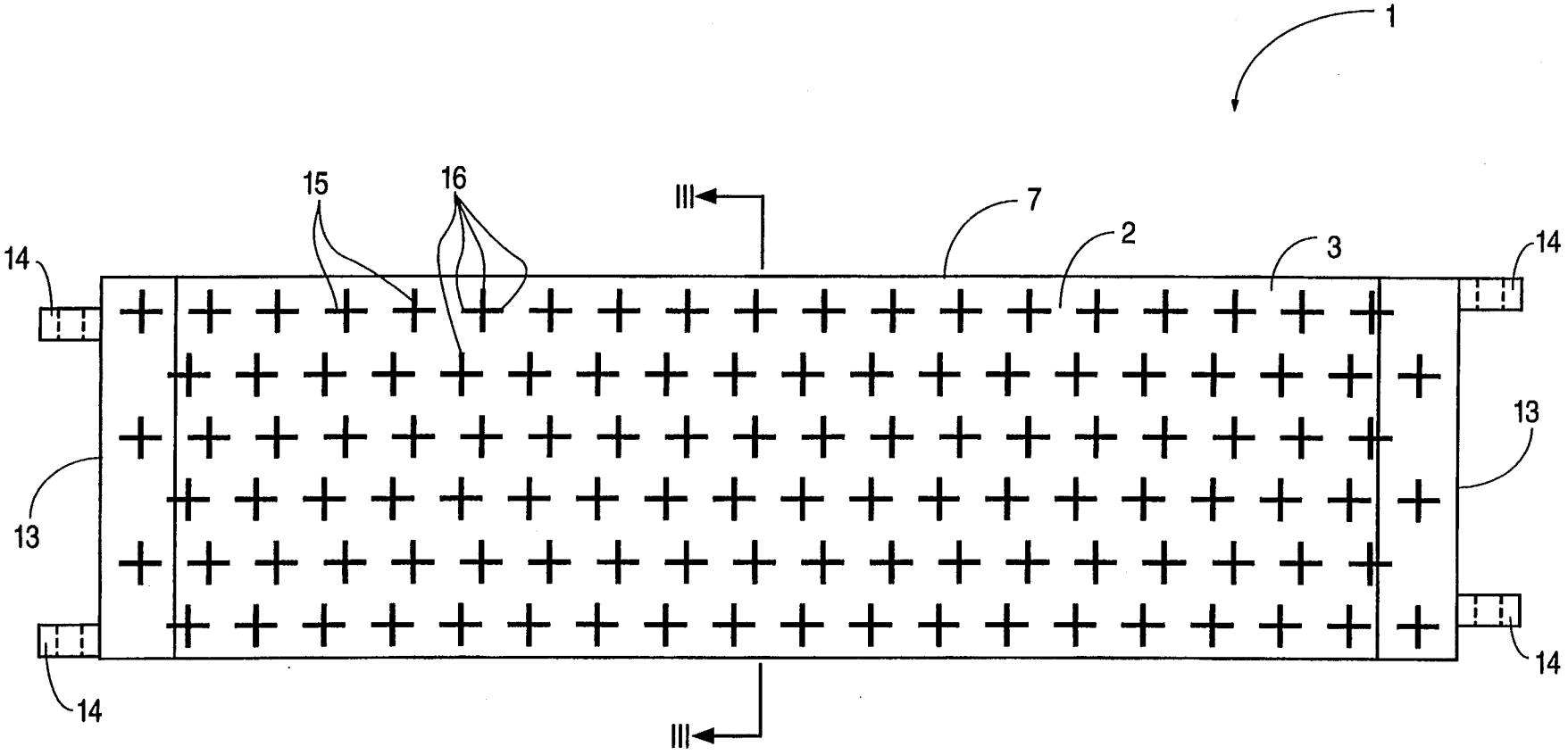
FIG. 4 shows a variant of a scaffold board with a view similar to FIG. 1.

FIG. 4 shows a variant of a scaffold board 1 which corresponds to the above-described scaffold board in all essential features, so that identical reference numerals are used for the same or similar components.

In contrast to the above-described scaffold board, the embossments 15 are not arranged in the form of a herring bone pattern. In the variant shown in FIG. 4, the embossments are rather in the form of crosses which are offset relative to each other in the longitudinal direction and the transverse direction of the scaffold board. The free ends 16 of these crosses pass into embossment-free sections of the upper side 2 of the scaffold board. This prevents the embossments from extending without interruption the transverse direction or longitudinal direction of the scaffold board.

Figure 5:
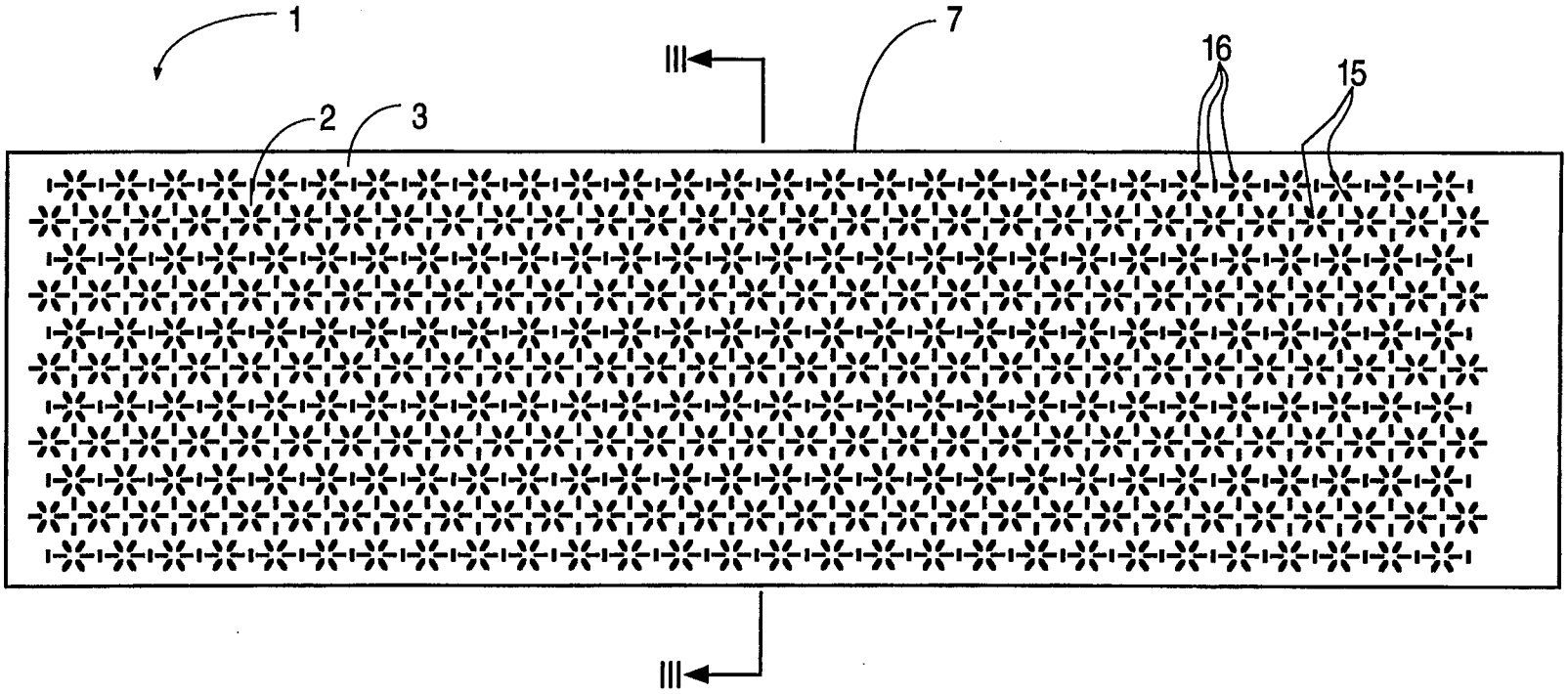
FIG. 5 shows another variant of a scaffold board with a view similar to FIG. 1.

FIG. 5 shows another variant of a scaffold board which also corresponds to the above-described scaffold boards in all essential features, so that identical reference numerals are also used for the same or similar components. In contrast to previous variants, the embossments are provided in the form of patterns with small stars that are offset relative to each other. These individual embossments 15 have various orientations and are grouped as stars that are offset relative to each other.

I claim:

1. A method for making a scaffold board for a building scaffold comprising connecting a substantially smooth and continuous upper sheet section, which forms the upper side of said scaffold board, to a waved lower sheet section, which comprise wave bottoms and tops of a trapezoidal cross-section and forms the bottom side of said scaffold board, the wave tops of said lower sheet section being adjacent to said upper sheet section, and filling a cavity formed between said upper and lower sheet sections with a foam which expands during curing, wherein said lower sheet section is connected to said upper sheet section at a plurality of connection points on the wave tops of said lower sheet section, said connection points defining unconnected regions between said upper sheet section and the wave tops of said lower sheet section, such that said foam squeezes said sheet sections apart during curing, penetrating between said upper sheet section and the wave tops of said lower sheet section in said unconnected regions.

2. The method of claim 1, characterized in that said foam is polyurethane foam.

3. The method according to claim 2, characterized in that said upper sheet section is bent downwards along its longitudinal edges and surrounds the longitudinal edges of said lower sheet.

4. The method according to claims 2 or 3, characterized in that the longitudinal edges of said lower sheet section are formed by wave bottoms which are spaced apart from said upper sheet section.

5. The method according to claim 4, characterized in that said lower sheet section includes, adjacent to said longitudinal edges, a longitudinally extending, upwardly directed bead which is engaged by said upper sheet section with the aid of a hook-shaped engaging portion.

6. The method according claim 5, characterized in that said upper sheet section which forms the upper side of said scaffold board has a walking surface with embossments.

7. The method according to claim 6, characterized in that said embossments extend towards the upper side of said scaffold board.

8. The method according to claim 7, characterized in that said embossments have a length greater than their width and are arranged in a pattern similar to a herring bone pattern.

9. The method according to claim 8, characterized in that said herring bone pattern is arranged in a direction oblique to the longitudinal direction of said scaffold board, so that embossments of different longitudinal directions are arranged on the longitudinal edges of said walking surface.

10. The method according to claim 9, characterized in that said lower sheet section has a thickness smaller than the thickness of said upper sheet section.

11. The method according to claim 6, characterized in that said embossments are in the form of crosses which are offset relative to each other in the longitudinal direction and the transverse direction of said scaffold board and/or in the form of stars whose free ends terminate in embossment-free sections of said upper side.

12. A scaffold board for a building scaffold comprising a substantially smooth and continuous upper sheet section, which forms the upper side of said scaffold board, a waved lower sheet section, which comprises wave bottoms and tops of a trapezoidal cross-section and forms the bottom side of said scaffold board, the wave tops of said lower sheet section being adjacent to said upper sheet section, and cavities formed between said upper and lower sheet sections that are filled with a foam which expands during curing, wherein said lower sheet section is connected to said upper sheet section at a plurality of connection points on the wave tops of said lower sheet section, said connection points defining unconnected regions between said upper sheet section and the wave tops of said lower sheet section, such that said foam squeezes said sheet sections apart during curing, penetrating between said upper sheet section and the wave tops of said lower sheet section in said unconnected region.

13. A scaffold board as in claim 12, characterized in that said foam is polyurethane foam.

14. A scaffold board according to claim 13, characterized in that said upper sheet section is bent downwards along its longitudinal edges and surrounds the longitudinal edges of said lower sheet.

15. A scaffold board according to claim 13 or 14, characterized in that the longitudinal edges of said lower sheet section are formed by wave bottoms which are spaced apart from said upper sheet section.

16. A scaffold board according to claim 15 characterized in that said lower sheet section includes, adjacent to said longitudinal edges, a longitudinally extending, upwardly directed bead which is engaged by said upper sheet section with the aid of a hook-shaped engaging portion.

17. A scaffold board according to claim 16, characterized in that said upper sheet section which forms the upper side of said scaffold board has a walking surface with embossments.

18. A scaffold board according to claim 17, characterized in that said embossments extend towards the upper side of said scaffold board.

19. A scaffold board according to claim 18, characterized in that said embossments have a length greater than their width and are arranged in a pattern similar to a herring bone pattern.

20. A scaffold board .according to claim 19, characterized in that said herring bone pattern is arranged in a direction oblique to the longitudinal direction of said scaffold board, so that embossments of different longitudinal directions are arranged on the longitudinal edges of said walking surface.

21. A scaffold board according to claim 20, characterized in that said lower sheet section has a thickness smaller than the thickness of said upper sheet section.

22. A scaffold board according to claim 17, characterized in that said embossments are in the form of crosses which are offset relative to each other in the longitudinal direction and the transverse direction of said scaffold board and/or in the form of stars whose free ends terminate in embossment-free sections of said upper side.

* * * * *

UNITED STATES PATENT AND TRADEMARK OFFICE

CERTIFICATE OF CORRECTION

PATENT NO. : 5,443,137
DATED : August 22, 1995
INVENTOR : Wolfgang Welser

It is certified that error appears in the above-identified patent and that said Letters Patent is hereby corrected as shown below:

Column 1, line 41:
After "foaming", insert --the cavity--.

Column 6, line 37:
After "board", delete ".".

Signed and Sealed this

Fourteenth Day of May, 1996

*Attest:*

Bruce Lehman

BRUCE LEHMAN

*Attesting Officer*

*Commissioner of Patents and Trademarks*